United States Patent [19]

Munson et al.

[11] Patent Number: 4,511,868

[45] Date of Patent: Apr. 16, 1985

[54] APPARATUS AND METHOD FOR TRANSFER OF R.F. ENERGY THROUGH A MECHANICALLY ROTATABLE JOINT

[75] Inventors: Robert E. Munson; Hussain A. Haddad, both of Boulder, Colo.

[73] Assignee: Ball Corporation, Muncie, Ind.

[21] Appl. No.: 417,517

[22] Filed: Sep. 13, 1982

[51] Int. Cl.[3] ..... H01P 1/06

[52] U.S. Cl. ..... 333/257; 333/21 A; 343/783; 343/763

[58] Field of Search ..... 333/256, 257, 261, 21 A; 343/783

[56] References Cited

U.S. PATENT DOCUMENTS

| | | | |
|---|---|---|---|
| 2,401,572 | 6/1947 | Korman . | |
| 2,426,226 | 8/1947 | Labin et al. . | |
| 2,526,383 | 10/1950 | Meier | 333/21 A X |
| 2,535,251 | 12/1950 | Alford | 333/257 |
| 2,596,398 | 5/1952 | Habich | 333/257 |
| 2,643,336 | 6/1953 | Valensi . | |
| 2,763,860 | 9/1956 | Ortusi et al. | 343/783 X |
| 2,867,776 | 1/1959 | Wilkinson, Jr. . | |
| 2,990,526 | 6/1961 | Shelton, Jr. . | |
| 3,289,122 | 11/1966 | Vural . | |
| 3,414,903 | 12/1968 | Bartlett et al. | 343/783 X |
| 3,441,784 | 4/1969 | Heil . | |
| 3,594,667 | 7/1971 | Mann . | |
| 3,786,376 | 1/1974 | Munson et al. . | |
| 3,860,891 | 1/1975 | Hiramatsu . | |
| 3,914,715 | 10/1975 | Hubing et al. . | |
| 4,163,961 | 8/1979 | Woodward . | |
| 4,222,017 | 9/1980 | Foldes | 333/21 A X |
| 4,233,580 | 11/1980 | Treczka . | |
| 4,253,101 | 2/1981 | Parr . | |
| 4,258,365 | 3/1981 | Hockham et al. . | |

*Primary Examiner*—Paul Gensler

*Attorney, Agent, or Firm*—Gilbert E. Alberding

[57] ABSTRACT

The wide ends of two similar horn structures are juxtaposed and joined by a rotary bearing extending thereabout which permits relative rotational motion between the two horn structures. A field shaping lens may be disposed at the relatively rotatable horn juncture to help insure substantially planar wavefront shapes across the relatively rotatable joint. An annular aperture may also be provided between the relatively rotatable horns and electrically loaded so as to present an approximate short circuit electrical impedance at the intended frequency of operation.

23 Claims, 2 Drawing Figures

Figure 1:
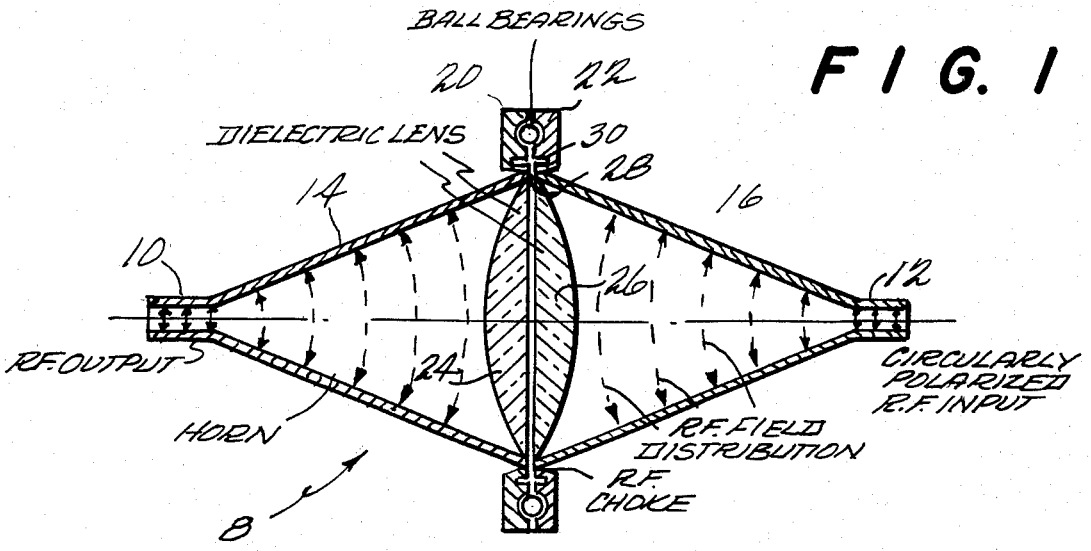

APPARATUS AND METHOD FOR TRANSFER OF R.F. ENERGY THROUGH A MECHANICALLY ROTATABLE JOINT

This invention is generally related to radio frequency transmission conduits including a mechanically rotatable joint. In particular, it is directed to an r.f. rotary joint especially adapted for the transfer of high power microwave frequency energy as well as lower level signals.

This application is related to our co-pending commonly assigned U.S. application Ser. No. 404,655 filed on Aug. 3, 1982 and relating to an r.f. rotary joint for lower level r.f. signals and employing a pair of annular microstrip antenna radiators for transferring r.f. energy across a mechanically rotatable joint.

Some rotary joints have been devised in the past for transferring r.f. energy thereacross. For example:

U.S. Pat. No. 2,401,572—Korman (1947)
U.S. Pat. No. 2,426,226—Labin et al (1947)
U.S. Pat. No. 3,786,376—Munson et al (1974)
U.S. Pat. No. 3,914,715—Hubing et al (1975)
U.S. Pat. No. 4,163,961—Woodward (1979)
U.S. Pat. No. 4,233,580—Treczka et al (1980)
U.S. Pat. No. 4,253,101—Parr (1981)
U.S. Pat. No. 4,258,365—Hockham et al (1981)

Korman teaches a type of capacitive coupling through a rotating joint for a parallel wire transmission line. Labin et al and Munson et al teach rotary coaxial cable couplers. Hubing et al achieve rotary coupling by a type of split coaxial ring structure. Woodward provides a rotary waveguide joint and Treczka et al teach a rotary coupler of a non-contact type having a rotary and a stationary resonant space which are ohmically coupled. Parr and Hockham et al are directed to similar disclosures of a rotary annular antenna feed coupler which appears to employ mated continuous rotating loops of "strip line" oriented in the axial dimension.

There may also have been other attempts to place rotary joints in waveguides and the use of rotating brush contact structures. However, insofar as presently understood by us, all such prior attempts have been relatively inefficient devices especially where high power level transfers are involved.

Of course, the use of stationary mated horn structures opposingly situated at a considerable distance from each other for coupling energy from one waveguide to another are known as are the use of various types of dielectric lens structures, etc. The following prior art is believed to be typical:

U.S. Pat. No. 2,643,336—Valensi (1953)
U.S. Pat. No. 2,867,776—Wilkinson, Jr. (1959)
U.S. Pat. No. 2,990,526—Shelton, Jr. (1961)
U.S. Pat. No. 3,289,122—Vural (1966)
U.S. Pat. No. 3,441,784—Heil (1969)
U.S. Pat. No. 3,594,667—Mann (1971)
U.S. Pat. No. 3,860,891—Hiramatsu (1975)

Valensi teaches opposingly situated rectangular horn structures for coupling energy from one waveguide to another while Wilkinson teaches a conical or circular waveguide structure for transferring energy therefrom to a following surface waveguide structure. The remainder of these just cited prior art patents appear to deal exclusively with various types of dielectric window structures used within waveguides for transferring energy from a section of the waveguide having one ambient pressure to another section of the waveguide having a different ambient temperature (e.g. a vacuum) or other similar applications. None of the patents in this latter group of cited references appear to be directly related to rotary joints.

Now, however, we have discovered a novel structure and method for efficiently transferring high power radio frequency energy across a rotary joint. This apparatus and method provides efficient signal and power transfer at all power levels (even up into the kilowatt and megawatt ranges). It provides a relatively broad bandwidth rotary joint having an extremely low voltage standing wave ratio (VSWR) and a low insertion loss.

The presently preferred exemplary embodiment of this invention provides a rotary joint comprised of two circular waveguides tapered through horn transitions and opposingly juxtaposed and interconnected for relative rotation with respect to one another through the opposed races of a ball bearing structure disposed thereabout. R.F. power transfer is accomplished by transforming spherical wavefronts in the horn into substantially planar wavefronts at the actual rotatable interface using a wavefront shaping lens structure (e.g. a shaped dielectric lens or delay waveguide lens or the like). After passage across the relatively rotatable joint, the substantially planar wavefront is then transformed back into spherical wavefronts in the opposed horn structure. In the presently preferred exemplary embodiment, the smaller ends of the horns connect to circular waveguides which operate in the circularly polarized $TE_{11}$ mode. An r.f. choke cavity loads the aperture at the juncture of the juxtaposed relatively rotatable horn structures so as to present an approximate short circuit electrical impedance at the intended frequencies of operation thereby ensuring a good transition from one horn structure to another (i.e., if the aperture appears as a short circuit, then there will in effect be electrical continuity between the relatively rotatable horn structures).

So far as is presently known, this invention provides the first reliable and efficient method and apparatus for transferring high power microwave frequency energy and/or signals across a mechanically rotatable joint. In brief summary, the method employed in the presently preferred exemplary embodiment involves transformation of $TE_{11}$ circularly polarized r.f. energy to spherically-shaped wavefronts and finally to substanially planar-shaped wavefronts in a first transition horn structure. The substantially planar wavefronts are then passed across the relatively rotatable joint into a second transition horn where they are transformed back to spherically-shaped wavefronts and finally into $TE_{11}$ circularly polarized r.f. energy. As should be appreciated, transmission can occur in either direction. Although the r.f. choke at an aperture between the relatively rotatable horns and a wavefront shaping lens disposed at the juncture of the two horn structures are both preferred, it will be appreciated that these latter two structures may in some applications not be necessary. For example, if a particular application permits the use of relatively long transition horns with very wide throats, then the spherically-shaped wavefronts at the horn throat may have such a large radius of curvature as to constitute a substantially planar-shaped wavefront for that particular application. Furthermore, depending on the amount of r.f. leakage that is deemed permissible at the rotary joint and upon other techniques that might be employed for ensuring electrical continuity thereacross, it may not always be necessary to include the r.f. choke comprising an aperture loaded by an electrical cavity.

Figure 2:
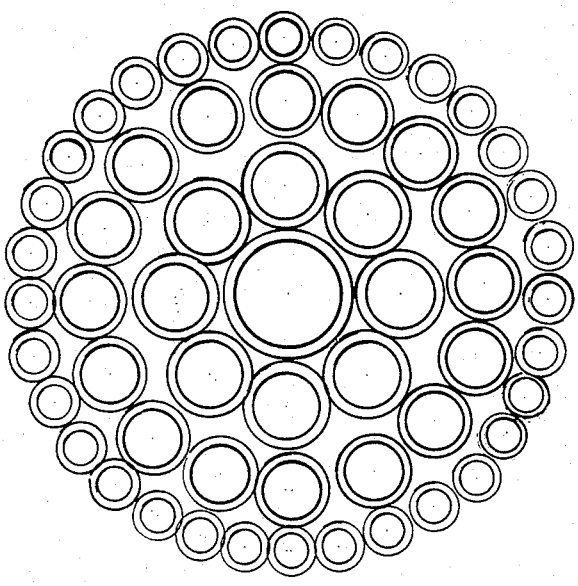

These as well as other objects and advantages of this invention will be better understood by a careful study of the following detailed description of the presently preferred exemplary embodiment of this invention taken in conjunction with the accompanying drawings, of which:

FIG. 1 is a cross-sectional view of the presently preferred exemplary embodiment of this invention; and FIG. 2 is an elevation view of an alternate delay waveguide lens that may be used in lieu of the dielectric lens structure shown in the embodiment of FIG. 1.

In the exemplary embodiment of FIG. 1, a rotary joint 8 is provided between sections 10 and 12 of a circular waveguide capable of bidirectionally transmitting high power microwave energy in the circularly polarized $TE_{11}$ mode. The circular waveguide 10 is terminated in a transition horn 14 while the circular waveguide 12 is terminated in a transition horn 16. The wider ends of the transition horns 14 and 16 are juxtaposed and affixed to the opposing races 20 and 22 of a ball bearing structure which circumscribes the juxtaposed large horn ends. Thus the two opposing horn structures may freely rotate with respect to one another.

The horns each transform $TE_{11}$ circularly polarized waveguide transmission modes into approximately spherically-shaped wavefronts and vice versa as indicated by dashed lines in FIG. 1. A dielectric lens comprising elements 24 and 26 mounted within the throat of horns 14 and 16, respectively then converts the spherical wavefronts to substantially planar wavefronts at the interface between the relatively rotatable horns.

In the exemplary embodiment, an annular aperture 28 exists between the relatively rotatable larger ends of horns 14 and 16. This aperture is backed by an electrical cavity 30 formed in the bearing races 20 and 22 which is dimensioned so as to present an approximate short circuit electrical impedance across the aperture 28 at the intended operating frequencies. As should be appreciated, this means that the electrical length from the front of aperture 28 to the short circuited rear of cavity 30 is approximately $\frac{1}{2}$ wavelength or integer multiples thereof. This cavity backed aperture then constitutes an r.f. choke so as to ensure a better transition region between the juxtaposed relatively rotatable horns 14 and 16. This not only helps prevent r.f. losses through the relatively rotatable joint but also helps prevent the unwanted creation of standing waves, etc. within the waveguide/horn structure which might otherwise result from large discontinuities in electrical impedance across the joint.

The dielectric lens structure 24 and 26 may be formed of many different dielectric materials. For example, ceramic materials, PTFE, nylon, synthetic resin materials such as Plexiglas, etc. are materials that might be considered for the dielectric lens. However, for higher power applications, ceramic materials are probably preferred because of their ability to withstand higher temperatures. As should be appreciated, a relatively low loss dielectric material should be used so as to minimize insertion losses across the joint. The necessary maximum thickness of the dielectric lens is of course minimized as the transition horns are lengthened such that the spherical wavefronts more and more closely approximate planar wavefronts across most of the horn aperture. In fact, if the axial length of the transition horns is made sufficient large, it may even be possible to eliminate the lens structure and still have acceptable performance for some applications.

The circular waveguides and transition horn structures are preferably formed of conventional metallic materials used for such purposes (e.g. aluminum, brass, etc.). As should be appreciated, the transition horns can be made integral with at least a section of the waveguide structure. Although any conventionally designed transition horn should be usable if used in conjunction with an appropriate conventionally designed dielectric lens structure, it is presently anticipated that most transition horns will have a half angle somewhere within the range of 15°–45°.

The dimensioning of the waveguide, transition horns, lens structures and r.f. choke cavities are believed to be within the ordinary skill of the art for any particular application. Operation may be had at any desired frequency within the normal operational frequency ranges of such circular waveguides and transition horns, etc. However, as will be appreciated, applications involving lower frequencies will involve relatively large sized structures. For example, if operation is expected in the X-band (7–12 gigahertz) the circular waveguides may be expected to have diameters on the order of 1 inch, where the wide throat of the horns will have a diameter on the order of 6 inches and where the axial length of the transition horns may be on the order of 6–12 inches or so.

Dielectric lens structures similar to elements 24 and 26 are believed to have been employed heretofore at the throat of stationary waveguide transition horns so as to convert the actually transmitted wavefront to an approximately planar shape. Accordingly, the detailed design of such a dielectric lens structure is believed to be well within the ordinary skill of the art.

An alternate wavefront shaping lens is shown at FIG. 2. This is a conventional delay waveguide lens which has various sized (length and width) waveguide segments arranged in an array designed so as to selectively delay the wavefront by different amounts at different regions thus changing the effective shape of the wavefront as it passes therethrough. As will be appreciated by those in the art, the speed of propagation through a waveguide varies in accordance with the diameter of the waveguide. Thus by using different length sections of different waveguide diameters and arrange them in a circularly symmetric pattern as shown in FIG. 2, it is possible to convert an incoming convex spherical wavefront from horn 14 into a properly directed concave spherical wavefront for transmission into horn 16 using the waveguide delay lens structure of FIG. 2 in place of the dielectric lens structures 24 and 26 shown in FIG. 1. Other wavefront shaping lens structures and/or techniques may also be appropriate for converting spherical wavefronts from one horn into oppositely directed spherical wavefronts suitable for transmission in/out of the other horn as should be appreciated.

Thus, in the exemplary embodiment, $TE_{11}$ circularly polarized r.f. energy is transformed to spherically-shaped r.f. wavefronts and eventually substantially planar-shaped r.f. wavefronts in one of the transition horns. After passage into the other transition horn, a converse transformation occurs into properly directed spherical wavefronts and finally back into circularly polarized $TE_{11}$ mode energy although relative rotation is permitted between the juxtaposed wide ends of the two transition horns. Preferably, an approximate electrical short circuit is created at aperture 28 between the relatively rotatable wide ends of the transition horns.

While only one presently preferred exemplary embodiment of this invention and one modification thereof have been described in detail above, those skilled in the art will understand that many variations and modifications may be made in this exemplary embodiment without materially departing from the novel advantages and features of this invention. Accordingly, all such variations and modifications are intended to to be included within the scope of the following claims.

What is claimed is:

1. An r.f. rotary joint comprising:

a first horn means having a small end and a large end for forming substantially planar r.f. wave fronts at its large end;

a second horn means having a small end and a large end for forming substantially planar r.f. wavefronts at its large end;

the large ends of said horn means being opposingly juxtaposed so that said substantially planar r.f. wavefronts can pass between said large ends substantially independently of the relative rotational positions of said horns; and a rotary motion bearing disposed about and physically interconnecting said juxtaposed large ends of the horn means;

wherein at least one of said horn means includes at least one r.f. lens structure disposed at the juncture of said juxtaposed large ends of the horn means.

2. An r.f. rotary joint as in claim 1 further comprising an annular aperture disposed at the juncture of said large ends of the horn means, which aperture presents an approximate short circuit electrical impedance at the intended frequency of operation.

3. An r.f. transmissive rotary joint as in claim 1 wherein said r.f. lens structure comprises separate first and second sections respectively disposed within the large ends of said first and second horn means.

4. An r.f. transmissive rotary joint as in claim 1 or 3 wherein said r.f. lens structure comprises a shaped dielectric lens.

5. An r.f. transmissive rotary joint as in claim 4 wherein said dielectric lens is formed of ceramic material.

6. An r.f. transmissive rotary joint as in claim 1 wherein said r.f. lens structure comprises a delay waveguide lens structure.

7. An r.f. rotary joint for transferring radio frequency energy thereacross, said rotary joint comprising:

a first waveguide means for passing circularly polarized radio frequency energy therealong and therethrough;

a first horn means having one end connected to an end of said first waveguide means and transitioning outwardly therefrom to a larger end to form a substantially planar r.f. wavefront at said larger end;

a second waveguide means for passing circularly polarized radio frequency energy therealong and therethrough;

a second horn means having one end connected to an end of said second waveguide means and transitioning outwardly therefrom to a larger end to form a substantially planar r.f. wavefront at said larger end; and rotary bearing means disposed about and interconnecting the larger ends of both said first and second horn means while permitting relative rotational motion therebetween.

8. An r.f. rotary joint as in claim 7 wherein:

said first and second waveguide means comprise metallic circular waveguides for passing circularly polarized radio frequency energy, and said first and second horn means comprise truncated conical metallic structures having circular cross-sections for transforming circularly polarized $TE_{11}$ radio frequency energy at the smaller end thereof to radio frequency energy having spherically-shaped wavefronts at the larger end thereof, and wherein said first and second horn means collectively further comprise lens means disposed at the juncture between the larger ends of said first and second horn means for converting radio frequency energy from spherically-shaped wavefronts directed from one horn means into spherically-shaped wavefronts directed into the other horn means and vice-versa.

9. An r.f. rotary joint as in claim 8 wherein said lens means comprises:

a first lens structure disposed within the larger end of said first horn means for converting radio-frequency energy from spherically-shaped wavefronts into generally planar-shaped wavefronts and vice-versa, and a second lens structure disposed within the larger end of said second horn means for converting radio-frequency energy from spherically-shaped wavefronts into generally planar-shaped wavefronts and vice-versa.

10. An r.f. rotary joint as in claim 7, 8 or 9 wherein said lens means comprises a shaped dielectric lens.

11. An r.f. rotary joint as in claim 7, 8 or 9 wherein said lens means comprises a delay waveguide lens.

12. An r.f. rotary joint as in claim 7, 8 or 9 wherein said rotary bearing means comprises an annular aperture at the location of relative rotation which is connected to an electrical cavity that is dimensioned to present an approximate short circuit at the intended frequency of operation.

13. An r.f. rotary joint as in claim 12 wherein said rotary bearing means comprises ball bearings disposed between opposing metallic bearing races which each include a portion of said electrical cavity.

14. An r.f. transmissive rotary joint comprising:

a first circular waveguide having an end;

a first circularly cross-sectional horn having a smaller end connected to the end of said first circular waveguide and transitioning to a larger end;

a second circular waveguide having an end;

a second circularly cross-sectional horn having a smaller end connected to the end of said second circular waveguide and transitioning to a larger end;

the larger ends of said horns being of similar size and opposingly juxtapositioned; and a rotary motion bearing disposed about and physically interconnecting said larger ends of the horns.

15. An r.f. transmissive rotary joint as in claim 14 further comprising at least one r.f. lens structure disposed at the juncture of said larger ends of the horns.

16. An r.f. transmissive rotary joint as in claim 14 further comprising an annular aperture disposed at the juncture of said larger ends of the horns, which aperture presents an approximate short circuit electrical impedance at the intended frequency of operation.

17. An r.f. transmissive rotary joint as in claim 16 further comprising at least one r.f. lens structure disposed at the juncture of said larger ends of the horns.

18. An r.f. transmissive rotary joint as in claim 17 wherein said r.f. lens structure comprises separate first and second sections respectively disposed within the larger ends of the first and second horns.

19. An r.f. transmissive rotary joint as in claim 15, 17 or 18 wherein said r.f. lens structure comprises a shaped dielectric lens.

20. An r.f. transmissive rotary joint as in claim 19 wherein said dielectric lens is formed of ceramic material.

21. An r.f. transmissive rotary joint as in claim 15 or 17 wherein said r.f. lens structure comprises a delay waveguide lens structure.

22. A method for passing r.f. energy through a rotary joint, said method comprising the steps of:

transforming $TE_{11}$ circularly polarized r.f. energy to first spherically-shaped r.f. wavefronts in a first transition horn;

transforming said first spherically-shaped r.f. wavefronts to substantially planar-shaped r.f. wavefronts at the wide end of said first transition horn;

passing said substantially planar-shaped r.f. wavefronts directly into the juxtaposed wide end of a second transition horn whereat said substantially planar-shaped r.f. wavefronts are transformed to second spherically-shaped r.f. wavefronts;

transforming said second spherically-shaped r.f. wavefronts into $TE_{11}$ circularly polarized r.f. energy; and permitting relative rotation between the juxtaposed wide ends of said first and second transition horns.

23. A method as in claim 22 further comprising the step of producing an approximate short circuit electrical impedance at an aperture disposed between the relatively rotatable wide ends of said first and second transition horns.

* * * * *